United States Patent [19]

Beining

[11] 3,963,956

[45] June 15, 1976

[54] ARTICLE FOR INCREASING THE LIFE EXPECTANCY OF FILAMENT LIGHT BULBS

[76] Inventor: August H. Beining, 818 N. Adlena Drive, Fullerton, Calif. 92633

[22] Filed: Apr. 16, 1975

[21] Appl. No.: 568,502

[52] U.S. Cl. ..... 315/71; 315/200 R; 357/76; 357/79

[51] Int. Cl.[2] ..... H01K 1/62

[58] Field of Search ..... 315/71, 72, 58, 200 R, 315/205; 357/79, 76, 74

[56] References Cited

UNITED STATES PATENTS

| | | | |
|---|---|---|---|
| 3,467,937 | 9/1969 | Norton | 315/71 UX |
| 3,800,192 | 3/1974 | Eisele et al. | 357/79 X |
| 3,823,339 | 7/1974 | Borneman et al. | 351/71 X |

*Primary Examiner*—R. V. Rolinec
*Assistant Examiner*—Darwin R. Hostetter
*Attorney, Agent, or Firm*—Philip M. Hinderstein

[57] ABSTRACT

An article positionable in a conventional light bulb socket for decreasing the power input and limiting the power turn-on and turn-off transients to a bulb inserted into such socket to thereby increase the life expectancy of the light bulb. The article includes a wafer of insulating material having a notch in the perimeter thereof, an axial lead diode or other power decreasing and/or transient limiting device positioned in the notch, the leads of the device extending radially inwardly and being positioned and/or coiled into spiral patterns or other patterns to form electrical terminals at the center of the wafer, on opposite sides thereof, and a pair of flexible pads of insulating material having widths approximately equal to the inside diameter of the base of the light bulb socket, the pads being secured to opposite sides of the wafer, the diode, and each other, each pad having a central opening therein to expose the electrical terminals.

8 Claims, 4 Drawing Figures

ARTICLE FOR INCREASING THE LIFE EXPECTANCY OF FILAMENT LIGHT BULBS

BACKGROUND OF THE INVENTION

1. Field of the Invention

The present invention relates to an article for increasing the life expectancy of filament light bulbs and, more particularly, to an article which is simply positionable in a light bulb socket and includes a standard, conventionally packaged, power decreasing and/or transient limiting device which is automatically placed in circuit with the light bulb for increasing the life expectancy thereof.

2. Description of the Prior Art

The life expectancy of conventional filament light bulbs is in the approximate range of 750 to 1,200 hours. While this seems like a long period of time, very often, as in the case of light bulbs that burn continuously, it is not. Thus, we are all faced with the problem of continuously changing light bulbs. This is not only expensive, but often, especially in the case of establishments which use a large number of light bulbs, a continuous series of problems.

It is known that the life expectancy of filament light bulbs can be substantially increased by decreasing the power input thereto. It is also known that the life expectancy of filament light bulbs can be significantly increased by limiting the power turn-on and turn-off transients which occur each time power is applied thereto or removed therefrom. Thus, it is known to place resistors, thermistors, diodes, SCR's, and other circuit elements in series with a light bulb to decrease and/or limit the power thereto and/or to reduce power transients. Of these circuit elements, a diode, an SCR, or other on/off device is preferred because their higher efficiency reduces heating of the device, thereby wasting energy, which occurs with thermistors and other resistive devices. In fact, by placing an on/off device such as a diode in series with light bulbs so as to cut the power input by approximately a factor of two, and to also limit the power transients, an increase in the life expectancy of conventional filament bulbs by at least ten times may be expected.

With this information in mind, it has been known to rewire electrical circuits feeding light bulbs to include conventional power decreasing and/or transient limiting devices therein. However, because of the inconvenience of this approach, it has been used to an insignificant extent. Heretofore, there has been no simple and efficient way to insert conventional power decreasing and/or transient limiting devices such as a diode in a home light bulb circuit.

SUMMARY OF THE INVENTION

According to the present invention, these problems are solved in a manner unknown heretofore. According to the present invention, there is provided an article positionable in a conventional light bulb socket, which article includes a standard, conventionally packaged, power decreasing and/or transient limiting device, such as an axial lead diode, for decreasing by a factor of approximately two and for limiting the turn-on and turn-off transients from the power input to a filament light bulb inserted into the socket. With the present article installed in the socket, an increase by at least a factor of ten in the life expectancy of an ordinary filament light bulb may be expected. Also, with the present article installed in each of the sockets of circuits having two or more light bulbs controlled by the same switch, a reduction in wear and a resulting increase in the life expectancy of the switch may be expected because of the limiting of the power turn-on and turn-off transients by the article. Thus, the present article easily pays for itself in a matter of a few months, considering the light bulb replacement cost savings alone. Furthermore, the present article saves energy since in many cases, the decrease in light intensity need not be compensated for by an increase in the size of the light bulb. This would be the case in lighting porches, yards, signs, hallways, exit lights, night lights, etc. The present article is long lasting and the power dissipated thereby is essentially zero, resulting in efficient operation with a negligible effect on the socket temperature.

Briefly, the present article is positionable in a conventional light bulb socket for decreasing the power input and for limiting the power transients to a filament light bulb inserted into such socket to thereby increase the life expectancy of the light bulb and comprises a wafer of insulating material having a width smaller than the inside diameter of the base of the light bulb socket, a power decreasing device positioned in contact with a portion of the perimeter of the wafer, the leads of the device extending radially inwardly, on opposite sides of the wafer, into contact with electrical terminals at the center of the wafer, and a pair of flexible pads of insulating material having widths approximately equal to the inside diameter of the base of the light bulb socket, the pads being secured to opposite sides of the wafer, the device, and each other, each pad having a central opening therein to expose the electrical terminals.

According to the preferred embodiment of the invention, the device is a diode having a body and a pair of axial leads extending from opposite sides thereof and the wafer has a notch in the perimeter thereof, the notch conforming generally to the shape of and being slightly greater in size than the body of the diode for receipt thereof. Furthermore, the ends of the leads of the diode are positioned or coiled in spiral or other patterns for use as the electrical terminals. By placing a polarity mark on one side of the wafer, at the center thereof, visible through the central opening in the pad on such one side of the wafer, the mark defines the polarity of the diode.

OBJECTS

It is therefore an object of the present invention to provide an article for increasing the life expectancy of filament light bulbs.

It is a further object of the present invention to provide an article which is easily positionable in a conventional light bulb socket and includes a standard, conventionally packaged, power decreasing and/or transient limiting device which is automatically positioned in circuit with a light bulb inserted into such socket.

It is a still further object of the present invention to provide a technique for positioning a standard, conventionally packaged, power reducing/limiting device such as an axial lead diode in a light bulb socket for decreasing the power input and/or the power turn-on/turn-off transients to a bulb inserted into such socket.

It is another object of the present invention to provide an economical, easy to use, highly efficient, long lasting, energy saving article for increasing the life expectancy of conventional filament light bulbs.

Still other object, features, and attendant advantages of the present invention will become apparent to those skilled in the art from a reading of the following detailed description of the preferred embodiment constructed in accordance therewith, taken in conjunction with the accompanying drawings wherein like numerals designate like or corresponding parts in the several figures and wherein:

DESCRIPTION OF THE PREFERRED EMBODIMENT

Figure 1:
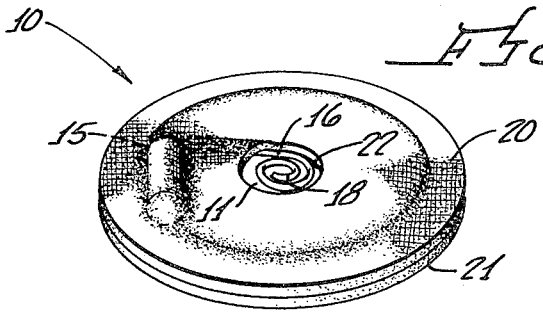
FIG. 1 is a perspective view of an article for increasing the life expectancy of filament light bulbs constructed in accordance with the teachings of the present invention.
Figure 2:
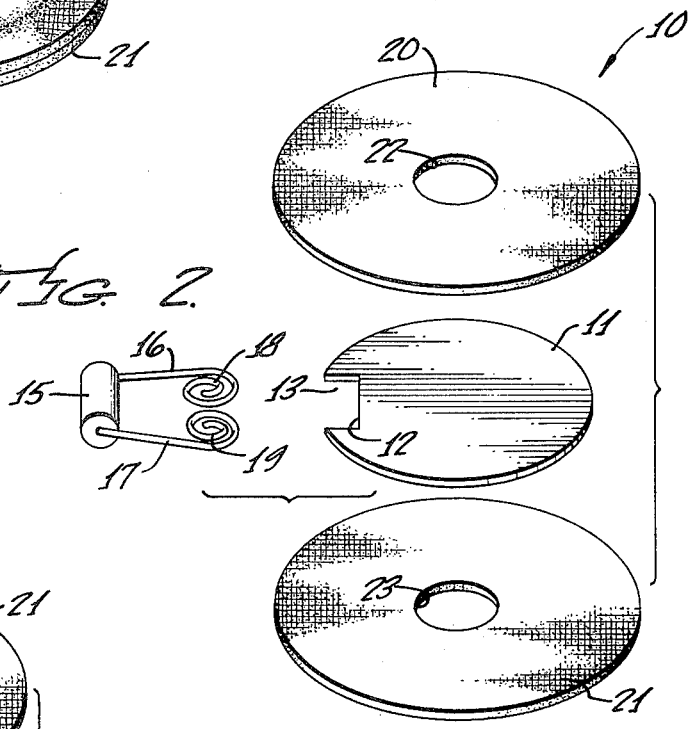
FIG. 2 is an exploded perspective view of the article of FIG. 1.
Figure 3:
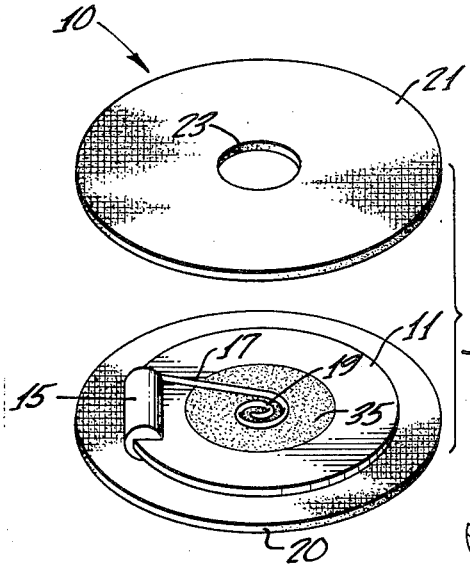
FIG. 3 is an inverted, partially exploded, perspective view of the article of FIG. 1.

Referring now to the drawings and, more particularly, to FIGS. 1–3 thereof, there is shown the present article, generally designated 10, for increasing the life expectancy of filament light bulbs. Article 10 comprises a wafer 11 of insulating material having a width which is greater than the diameter of the center contact area region of a light bulb base but less than the diameter of the base of a conventional light bulb socket. As shown in the drawings, wafer 11 is preferably circular but any other convenient shape may be used. Furthermore, preferably at least a portion 12 of the perimeter of wafer 11 is linear for reasons which will appear more fully hereinafter. While linear portion 12 of wafer 11 may extend entirely across wafer 11, so that the extremities of linear portion 12 terminate at the perimeter of wafer 11, linear portion 12 is preferably formed by providing a notch 13 in the perimeter of wafer 11, the size and shape of which will be discussed more fully hereinafter. Wafer 11 may be made from any suitable, thin, insulating material but is preferably made from Nomex, a trademark of Dupont for their brand of nylon paper.

Article 10 further includes a power decreasing and/or transient limiting device 15 having a body and a pair of axial leads 16 and 17 extending from opposite ends thereof. Preferably, device 15 is an axial lead diode. While it is possible to use other types of devices in article 10, an axial lead diode is chosen because it is a standard, conventionally packaged, highly efficient, power decreasing and transient limiting device that is presently inexpensive and widely available on the market. Other advantages of the use of this type of device will appear more fully hereinafter.

Notch 13 in the perimeter of wafer 11 preferably conforms generally to the shape of and is slightly greater in size than device 15 for receipt thereof. Thus, since standard axial lead diodes are cylindrical in shape, notch 13 is rectangular, the length of notch 13 being slightly greater than the length of device 15 and the depth of notch 13 being approximately equal to the diameter of device 15. In this manner, device 15 may be positioned in notch 13, parallel to and in contact with linear portion 12 of the perimeter of wafer 11, as shown in FIG. 3, notch 13 holding device 15, preventing movement thereof and providing mechanical protection and electrical isolation for leads 16 and 17. Furthermore, all surfaces of device 15 are sufficiently removed from the center of wafer 11 to preclude article 10 from interfering with and contacting the center contact region of a light bulb.

Leads 16 and 17 of device 15 are positioned so as to extend radially inwardly, on opposite sides of wafer 11, into contact with electrical terminals aligned with the center of wafer 11. According to the present invention, the ends of leads 16 and 17 are positioned and/or coiled into spiral or other patterns to form electrical terminals 18 and 19, respectively. The length of the uncoiled portions of leads 16 and 17 is adjusted so that with device 15 positioned in notch 13, terminals 18 and 19 of leads 16 and 17, respectively, are aligned with the center of wafer 11. In this manner, leads 16 and 17 in and of themselves provide electrical terminals, separated by insulating wafer 11, for connection in the light bulb circuit.

Article 10 further includes a pair of flexible pads 20 and 21 of insulating material having diameters approximately equal to (preferably slightly greater than) the inside diameter of the base of a conventional light bulb socket. By placing a suitable adhesive on the inside surface of each of pads 20 and 21, pads 20 and 21 may have the central portions thereof secured to opposite sides of wafer 11 and the outer portions thereof secured to each other and to the opposite sides of device 15, to encapsulate same. Thus, pads 20 and 21 fully enclose wafer 11 and device 15, forming a completed package. On the other hand, by providing pads 20 and 21 with central openings 22 and 23, respectively, terminals 18 and 19 at the ends of leads 16 and 17, respectively, are exposed, permitting electrical connection thereto.

Pads 20 and 21 may be made from any suitable, flexible insulating material used in conjunction with an appropriate adhesive, such as woven glass cloth electrical tape, which is readily available with a fire-retardant rating suitable for the present purpose. The use of a flexible material serves a variety of purposes, one of which is that pads 20 and 21 are permitted to conform to the irregular shape of device 15 when positioned in notch 13 of wafer 11.

Figure 4:
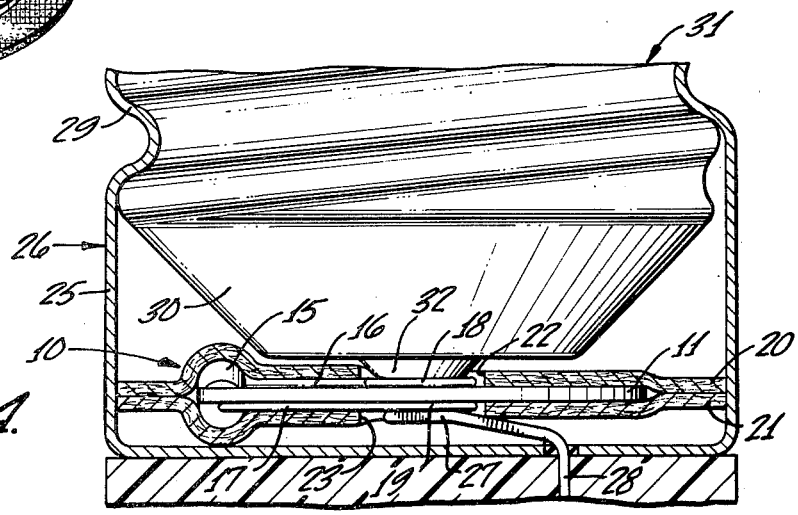
FIG. 4 is a sectional view taken through the axis of a conventional light bulb socket showing the relationship between the present article, such socket, and the base of a filament light bulb.

In operation, and referring to FIG. 4, article 10 is shown positioned in the base 25 of a conventional light bulb socket 26 including a centrally located electrical terminal 27 connected via an electrical lead 28 to a conventional source of power (not shown). Positioned within socket 26 is the base 30 of a conventional filament light bulb 31 having a centrally located electrical terminal 32 which normally makes contact with terminal 27 upon insertion of bulb 31 into socket 26.

Article 10 is positioned in socket 26 prior to the insertion of bulb 31 thereinto. Since pads 20 and 21 are made from a flexible material, article 10 readily slips passed the threads 29 of socket 26, which threads usually have a diameter less than the diameter at the base 25 of socket 26. Furthermore, once having passed threads 29, pads 20 and 21, having diameters slightly greater than the diameter of base 25 of socket 26, hold article 10 securely positioned in socket 26 and prevent the falling out thereof, even if socket 26 is inverted, as would be the case with a ceiling light fixture.

With article 10 in place, as shown in FIG. 4, bulb 31 may be screwed into socket 26, bringing electrical terminal 32 thereof into contact with terminal 18 and 19 of lead 16 or 17, respectively, depending upon which side of article 10 is facing outwardly, and bringing terminal 27 into contact with terminal 19 or 18 of lead 17 or 16, respectively, completing the electrical connection between terminals 27 and 32 via device 15. Assuming device 15 is a diode which is now connected in a circuit between terminals 27 and 32, one-half of each cycle of alternating current conducted to terminal 27 will be blocked and light bulb 31 will receive only approximately one-half of the normal power input. As discussed previously and as known in the art, a decrease by approximately a factor of two of the input power to bulb 31 will increase the life expectancy thereof by a factor of at least ten.

Furthermore, since a diode decreases the input power to bulb 31, the filament thereof is warmed to its normal operating temperature over a time interval which is approximately twice as long as the normal warming time interval, thereby reducing the mechanical shock experienced by the filament when the power is turned on. This feature contributes significantly to increasing the life expectancy of light bulb 31.

By the positioning of device 15 in notch 13 of wafer 11, as explained previously, device 15 is positioned, in use, beyond the edge of the center contact area region of base 30 of bulb 31, in a convenient location which has not been heretofore used for any practical purpose. Thus, a simple, readily available, inexpensive, conventionally packaged, power decreasing and transient limiting device such as an axial lead diode may be used in article 10 with the leads thereof connected to and/or utilized as electrical terminals.

Article 10 has several additional features which contribute to the convenience and practicality thereof. That is, and as shown in FIG. 3, a polarity mark 35, which need not be round as shown but may be of any appropriate shape or color, may be positioned on one or both sides of wafer 11, at the center thereof, mark 35 being visible through opening 22 in pad 20 and/or opening 23 in pad 21. By always placing devices 15 in notches 13 with the same orientation, mark 35 may be used to define the polarity thereof. Alternatively, a polarity mark or marks may be positioned on terminals 18 and/or 19 or on the outer surfaces of one or both pads 20 and 21 to achieve the same polarity indication. Therefore, when a number of articles 10 are used, the polarity of alternate articles 10 may be reversed to insure that approximately an equal number of light bulbs are on and off at the same time, thus balancing the circuit. Alternating articles 10 also assures a current path to reduce switch wear on circuits having two or more light bulbs controlled by the same switch.

Another feature of article 10 is in the positioning of leads 16 and 17 and coiled terminals 18 and 19, respectively, thereof. More specifically, when viewed from either side of wafer 11, leads 16 and 17 are both coiled in a clockwise direction. Thus, regardless of the direction in which article 10 is positioned within socket 26, tightening of bulb 31 in socket 26 will place a force on leads 16 and 17 in a direction to angularly separate leads 16 and 17 rather than placing thereon an angular compression force. In the event of a failure of device 15, this angular force will enable a separation of one or both of leads 16 and 17 from device 15, opening the circuit between terminals 27 and 32 and turning light bulb 31 off, advising the user of a failure of article 10. Had the insertion of bulb 31 placed leads 16 and 17 in respective angular compression, they may have been held against device 15 in the event of a failure thereof, possibly thereby short-circuiting at device 15 and directly connecting electrical terminals 27 and 32. In this event, bulb 31 would receive full power, accelerating the burning out thereof.

It can therefore be seen that in accordance with the present invention, there is provided an article 10 positionable in a conventional light bulb socket 26, article 10 including a standard, conventionally packaged, power decreasing and/or transient limiting device 15, such as an axial lead diode, for decreasing by a factor of approximately two and for limiting the turn-on and turn-off transients from the power input to a filament light bulb inserted into the socket. With a diode used as device 15 and with article 10 installed in a socket, an increase by at least a factor of ten in the life expectancy of an ordinary filament light bulb may be expected. Also, with article 10 installed in each of the sockets of circuits having two or more light bulbs controlled by the same switch, a reduction in wear and a resulting increase in the life expectancy of the switch may be expected because of the limiting of the power turn-on and turn-off transients by article 10. Thus, article 10 easily pays for itself in a matter of a few months, considering the light bulb replacement cost savings alone. Furthermore, article 10 allows use of conventional devices which are not only inexpensive but readily available.

When a diode is used as device 15, article 10 also saves energy since in many cases, the decrease in light intensity which results from the use thereof need not be compensated for by an increase in the size of the light bulb. This would be the case, for example, in lighting porches, yards, signs, hallways, exit lights, night lights, etc. Article 10, utilizing a diode as device 15, is long lasting and the power dissipated thereby is essentially zero, resulting in efficient operation with a negligible effect on the temperature of socket 26.

While the invention has been described with respect to a preferred physical embodiment constructed in accordance therewith, it will be apparent to those skilled in the art that various modifications and improvements may be made without departing from the scope and spirit of the invention. Accordingly, it is to be understood that the invention is not to be limited by the specific illustrative embodiment, but only by the scope of the appended claims.

I claim:

1. An article positionable in a conventional light bulb socket comprising:

a wafer of insulating material having a width smaller than the inside diameter of the base of said light bulb socket;

a power decreasing device positioned adjacent to or in contact with a portion of the perimeter of said wafer, the leads of said device extending radially inwardly, on opposite sides of said wafer, into contact with electrical terminals at the center of said wafer;

a pair of flexible pads of insulating material having widths approximately equal to said inside diameter of said base of said light bulb socket, said pads being positioned on opposite sides of said wafer, each pad having a central opening therein to expose said electrical terminals; and an adhesive securing the central portions of said pads to opposite sides of said wafer and the outer portions thereof to opposite sides of said device and to each other.

2. An article according to claim 1 wherein said device has a body positioned in contact with said wafer perimeter and a pair of axial leads extending from opposite ends of said body.

3. An article according to claim 2 wherein said device is a diode.

4. An article according to claim 2 wherein the ends of said leads of said device are positioned or coiled into spiral patterns for use as said electrical terminals.

5. An article according to claim 4 wherein said leads of said device are positioned on opposite sides of said wafer such that tightening of said bulb in said bulb socket places a force on said leads in a direction to angularly separate them.

6. An article according to claim 1 wherein said wafer has a notch in said perimeter thereof, said notch conforming generally to the shape of said device and being slightly greater in size than said device for receipt thereof.

7. An article according to claim 6 wherein the distance between said portion of said wafer perimeter and the center thereof is slightly greater than the radius of the base of the contact area region of a conventional light bulb whereby said device is positioned between said light bulb base and said light bulb socket base.

8. An article according to claim 1 wherein said wafer has a mark on one side thereof, at the center thereof, visible through the central opening in the pad on said one side of said wafer, said mark defining the polarity of said device.

* * * * *